US007070444B2

(12) United States Patent
Sato et al.

(10) Patent No.: US 7,070,444 B2
(45) Date of Patent: Jul. 4, 2006

(54) CABLE CONNECTOR

(75) Inventors: Kazuomi Sato, Tokorozawa (JP); Yoshinori Mizusawa, Tokyo (JP); Hisashi Ishida, Tokyo (JP); Masahiro Yamauchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 8 days.

(21) Appl. No.: 10/490,668

(22) PCT Filed: Sep. 26, 2001

(86) PCT No.: PCT/JP01/08362

§ 371 (c)(1),
(2), (4) Date: Aug. 17, 2004

(87) PCT Pub. No.: WO03/032443

PCT Pub. Date: Apr. 17, 2003

(65) Prior Publication Data

US 2005/0003701 A1 Jan. 6, 2005

(51) Int. Cl.
*H01R 12/24* (2006.01)

(52) U.S. Cl. ..... 439/496

(58) Field of Classification Search ..... 439/492, 439/495, 496

See application file for complete search history.

(56) References Cited

U.S. PATENT DOCUMENTS

| | | | | |
|---|---|---|---|---|
| 3,977,756 | A | 8/1976 | Rodondi | |
| 4,749,371 | A * | 6/1988 | Hirai et al. | 439/497 |
| 6,165,007 | A | 12/2000 | Higuchi et al. | |
| 6,217,344 | B1 | 4/2001 | Saito et al. | |
| 6,475,025 | B1 * | 11/2002 | Inoue | 439/495 |
| 6,551,128 | B1 * | 4/2003 | Asai | 439/495 |

FOREIGN PATENT DOCUMENTS

| | | |
|---|---|---|
| DE | 26 42 242 | 3/1977 |
| EP | 100 3245 | 5/2000 |
| EP | 1041682 | 10/2000 |
| JP | 52 40767 | 3/1977 |
| JP | S58 9982 | 7/1983 |
| JP | S59 17578 | 2/1984 |
| JP | S64 48873 | 3/1989 |
| JP | H06-7166 | 1/1994 |
| JP | 8171965 | 7/1996 |
| JP | 10125414 | 5/1998 |
| JP | 10255921 | 9/1998 |
| JP | 10 303529 | 11/1998 |
| JP | 11329619 | 11/1999 |
| JP | A H 11-329620 | 11/1999 |
| JP | 2000182694 | 6/2000 |
| JP | 2000 223189 | 8/2000 |
| JP | 2000 277190 | 10/2000 |

* cited by examiner

*Primary Examiner*—P. Austin Bradley
*Assistant Examiner*—X. Chung-Trans
(74) *Attorney, Agent, or Firm*—Collard & Roe, P.C.

(57) ABSTRACT

In a cable connector used for connecting cables (23, 24) having a plurality of wires, cable-side insulators (26, 27) each arraying and retaining the wires in one plane are made attachable/detachable relative to a base insulator (13) retaining contacts. The cable-side insulators connect the wires to the contacts when attached to the base insulator. The base insulator has a pair of base guide portions (15) extending while confronting each other. The cable-side insulators each have a pair of cover guide portions (45) of which movement is guided by the base guide portions. At least either of the base guide portions and the cover guide portions have projection portions that bring both of them mutually into a press-fitted relation in a cable connected state.

10 Claims, 17 Drawing Sheets

CABLE CONNECTOR

CROSS REFERENCE TO RELATED APPLICATIONS

Applicants claim priority under 35 U.S.C. §365 of PCT/JP01/08362 filed on Sep. 26, 2001. The international application under PCT article 21(2) was not published in English.

TECHNICAL FIELD

The present invention belongs to a cable connector for connecting between conductive contacts and wires of a cable.

BACKGROUND ART

Referring to FIGS. 1 and 2, description will be made of a cable connector in a first related technology. The illustrated cable connector comprises a base insulator 114 provided with a plurality of conductive contacts 112 mutually arrayed in two rows, two cover insulators 121, 122 having a long plate shape and sandwiching two cables 117, 118 each arranged with a plurality of wires arrayed in a flat manner at predetermined intervals to each other, to thereby retain them, and a plurality of conductive cable-connection contacts 125 provided on the two cover insulators 121, 122, respectively.

The contact 112 comprises a socket portion 112*a* adapted to contact with the cable-connection contact 125, and a pin-shaped contact portion 112*b* adapted to contact with a counterpart contact of a counterpart connector not illustrated. The cable-connection contact 125 comprises a pin-shaped connection contact portion 125*a* provided between a plurality of grooves 131, 132 formed at one edge portion of each of the two cover insulators 121, 122, and a connection retaining portion 125*b* driven into each of a plurality of holes 135 formed near the grooves 131, 132.

The base insulator 114 comprises a base portion 114*b* including a fitting portion 114*a* that is open and arranged with the contact portions 112*b* for receiving the counterpart connector (not illustrated) fitted thereinto to bring the counterpart contacts into contact with the contacts 112, and base fixing portions 114*c* provided on both sides of the base portion 114*b*. The base fixing portion 114*c* is formed with a base screw hole 114*d*. Further, the two cover insulators 121, 122 are each formed with cover screw holes 121*a* to 121*d*, 122*a* to 122*d* near four corners thereof.

The two cables 117, 118 are sandwiched between the two cover insulators 121, 122. On the upper cover insulator 121, the wires of the upper cable 117 are connected to the upper cable-connection contacts 125 in one-to-one correspondence. On the lower cover insulator 122, the wires of the lower cable 118 are connected to the lower cable-connection contacts 125 in one-to-one correspondence.

Thereafter, the two cover insulators 121, 122 are screwed to each other by engaging screws 141 into the cover screw holes 121*a* to 121*d*, 122*a* to 122*d* for fixedly sandwiching the cables 117, 118. The two cover screw holes 122*b*, 122*c* are matched in position with the base screw holes 114*c*, 114*d* and screwed thereto. The two cover insulators 121, 122 are connected to the contacts 112 in the state where they are retained to the base insulator 114.

An example of a cable connector according to the first related technology is also disclosed in Japanese Patent Application Publication (JP-A) No. H10-303529.

With respect to the cable connector according to the first related technology 1, however, the base insulator 114 and the cover insulators 121, 122 are held by jigs (not illustrated), respectively, and connection is carried out along guides of the jigs, and therefore, reliability upon the connection is poor. Further, the cover insulators 121, 122 and the base insulator 114 are screwed to each other to fix the cover insulators 121, 122, thereby achieving rigidity of the whole cable connector. However, the screwing operation takes much time and, if trying to achieve automation, facilities become complicated, which thus has been a factor of poor economical efficiency.

Referring now to FIG. 3, description will be made of a cable connector according to a second related technology. The illustrated cable connector uses one coaxial flat ribbon-shaped cable 117 like the cable shown in FIG. 1. The cable 117 has an end portion formed as a cable curved portion 117*a* having a generally S-shaped side and having been subjected to bending. The cable curved portion 117*a* is fixed by concavo-convex portions 121*e*, 122*e* formed by two cover insulators 121, 122.

In this case, operations such as a process of bending the cable 117 and a strip process of stripping the cable 117 of its coating portions to expose wires, are carried out.

Further, referring to FIG. 4, description will be made of a cable connector according to a third related technology. In the illustrated cable connector, two cables 117, 118 like the cables shown in FIG. 1 are overlapped each other via an intermediate member 161. The cables 117, 118 are sandwiched and fixed by two cover insulators 121, 122 as shown in FIG. 1 and the intermediate member 161. The cables 117, 118 are provisionally fixed to the cover insulators 121, 122 using double-coated tapes 165, 166, respectively. The intermediate member 161 serves to prevent coming-off of the cables 117, 118.

Examples of cable connectors according to the second and third related technologies are also disclosed in Japanese Patent Application Publication (JP-A) No. H11-329620.

With respect to the cable connector according to the second related technology, however, there is a problem that the bent cable 117 is in an unstable state until the cover insulator 121 and the cover insulator 122 are united with each other so that it is difficult to automate the operations.

Further, with respect to the cable connector according to the third related technology, much time is required for the operation of sticking the cables 117, 118 onto the cover insulators 121, 122. Further, upon moving between the operation processes, there are instances where an external force is exerted to the cables 117, 118 to tear off the stuck cables 117, 118.

Further, there is a problem that inasmuch as the intermediate member 161 is provided between the cables 117, 118, it becomes unstable even in case of automatic assembly.

DISCLOSURE OF THE INVENTION

It is therefore an object of the present invention to provide a cable connector that can improve reliability of connection and ensure rigidity of the whole connector in a connected state.

It is another object of the present invention to provide a cable connector that can achieve automation of production with simple facilities and thus is excellent in economics.

It is still another object of the present invention to provide a cable connector that can reduce operation processes for retaining a cable to shorten an operation time and that can accurately manage the overall length of a cable harness assembly.

It is still another object of the present invention to provide a cable connector that can prevent movement of a cable even when an external force is exerted on the cable, thereby to improve yield upon connection.

According to the present invention, there is obtained a cable connector used for connecting a cable having a plurality of wires, the cable connector characterized by comprising a plurality of conductive contacts; a base insulator retaining the contacts; and a cable-side insulator attachable/detachable relative to the base insulator, arraying and retaining the wires in one plane, and connecting the wires to the contacts when attached to the base insulator, wherein the base insulator has a base portion arraying the contacts at predetermined intervals to each other, and a pair of base guide portions extending from both ends of the base portion while confronting each other, the cable-side insulator has a pair of cover guide portions of which movement is guided by the base guide portions, and at least either of the base guide portions and the cover guide portions have projection portions that bring the base guide portions and the cover guide portions mutually into a press-fitted relation in a cable connected state where the wires are connected to the contacts.

BEST MODE FOR CARRYING OUT THE INVENTION

Figure 1:
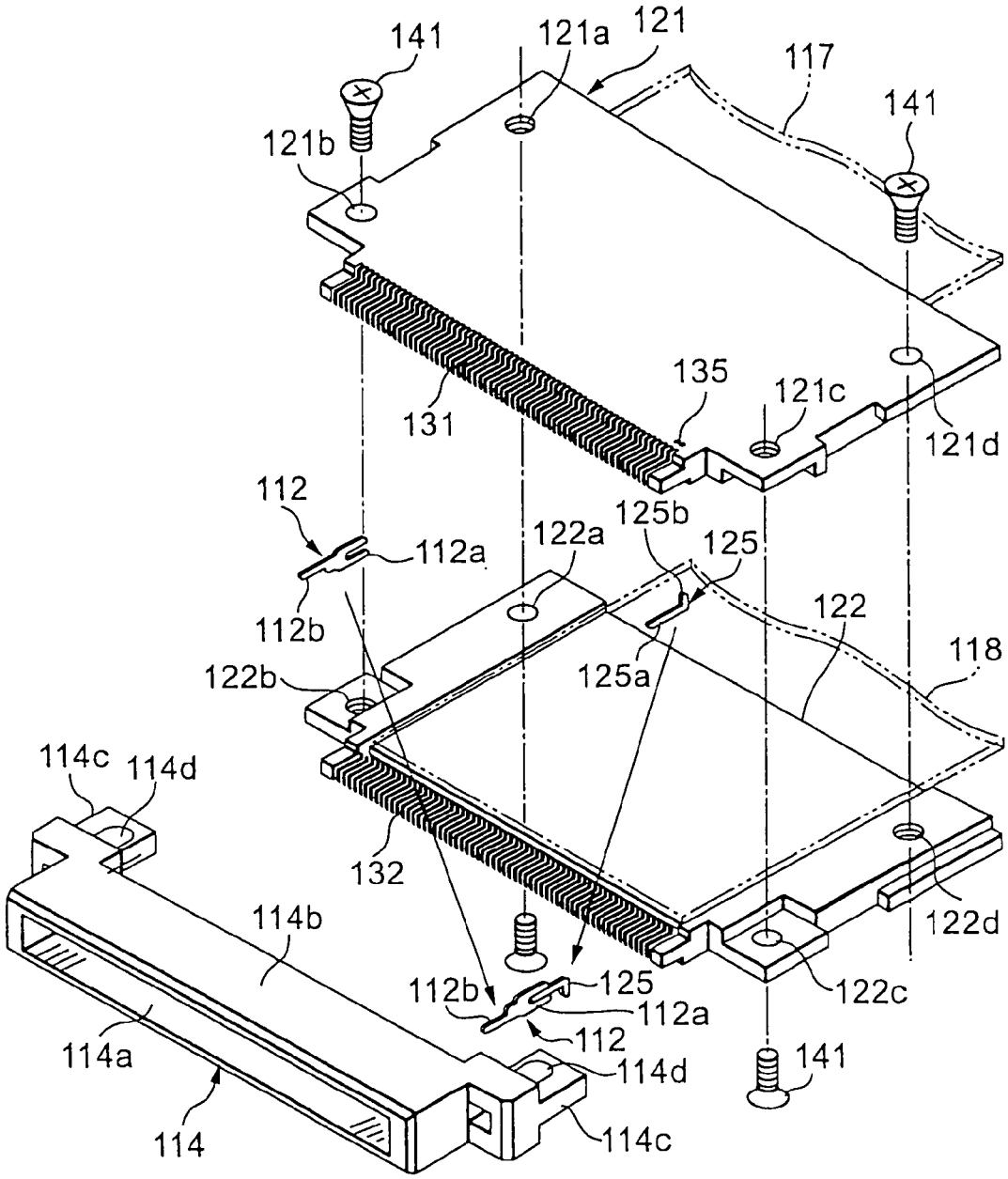
FIG. 1 is an exploded perspective view of a cable connector in a first related technology.
Figure 2:
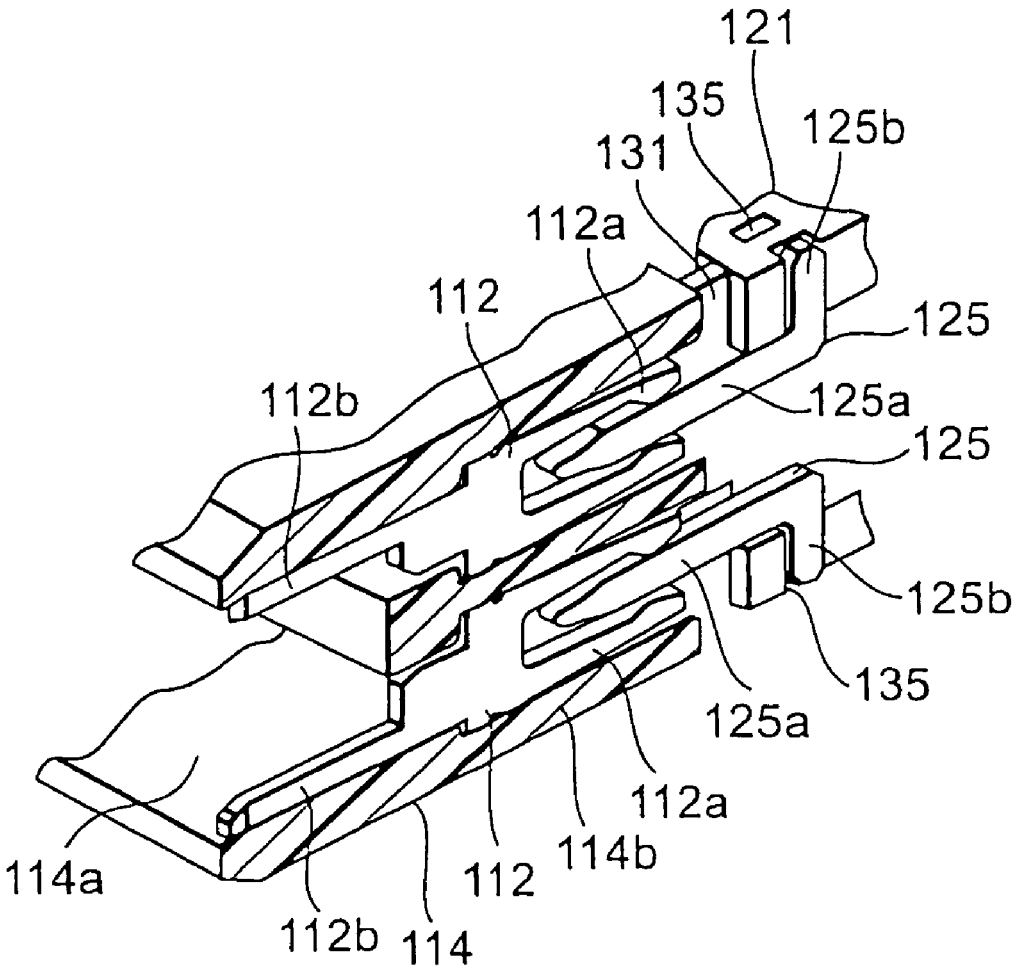
FIG. 2 is a sectional view showing the main part of the cable connector shown in FIG. 1.
Figure 3:
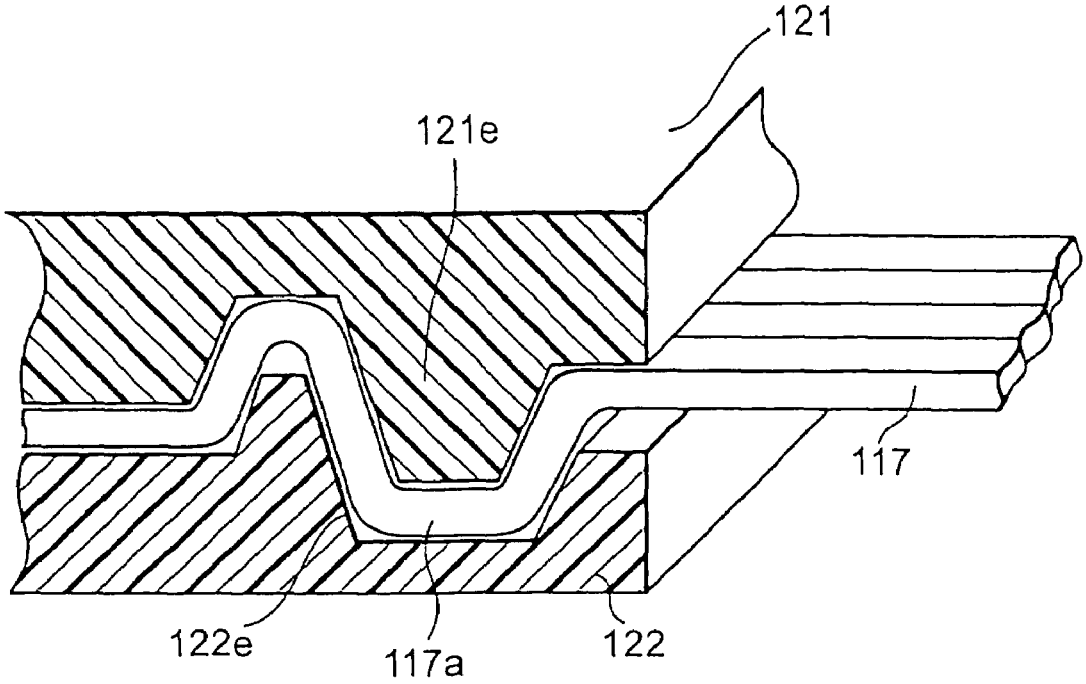
FIG. 3 is a sectional view showing the main part of a cable connector in a second related technology.
Figure 4:
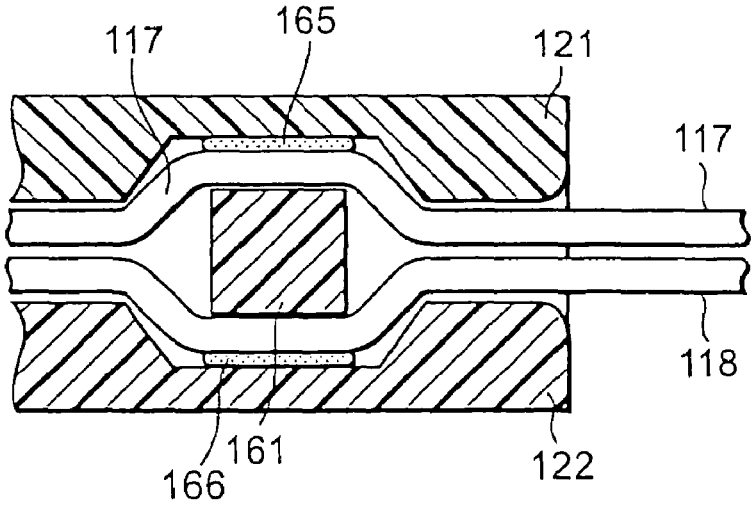
FIG. 4 is a sectional view showing the main part of a cable connector in a third related technology.
Figure 5:
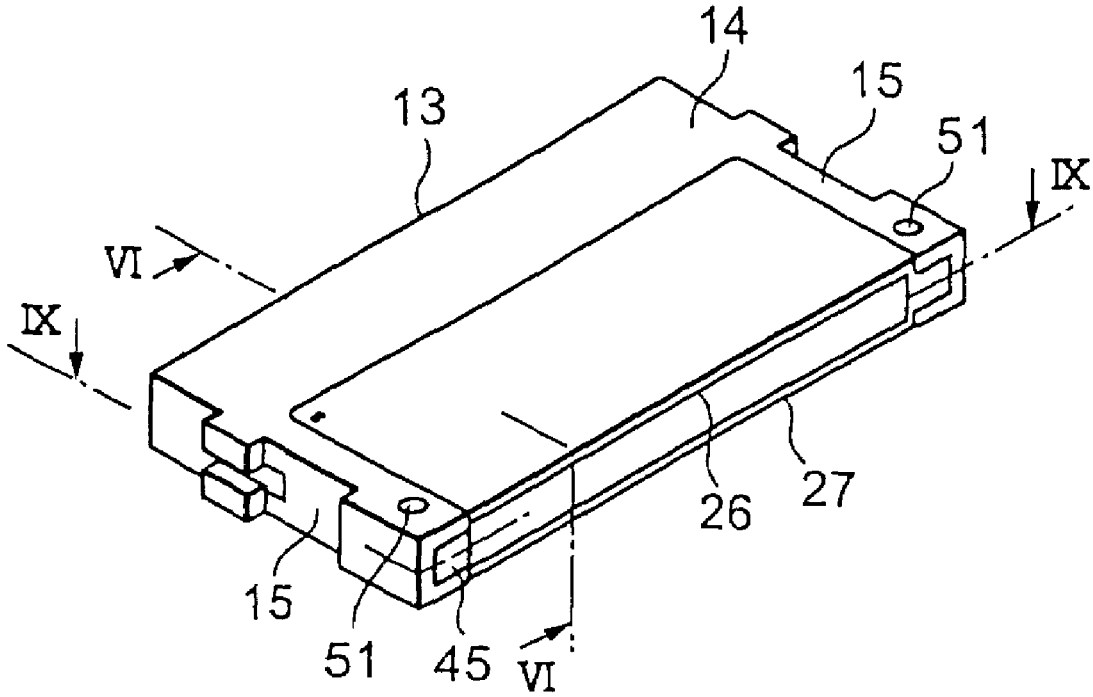
FIG. 5 is a perspective view of a cable connector according to a first embodiment of the present invention.
Figure 6:
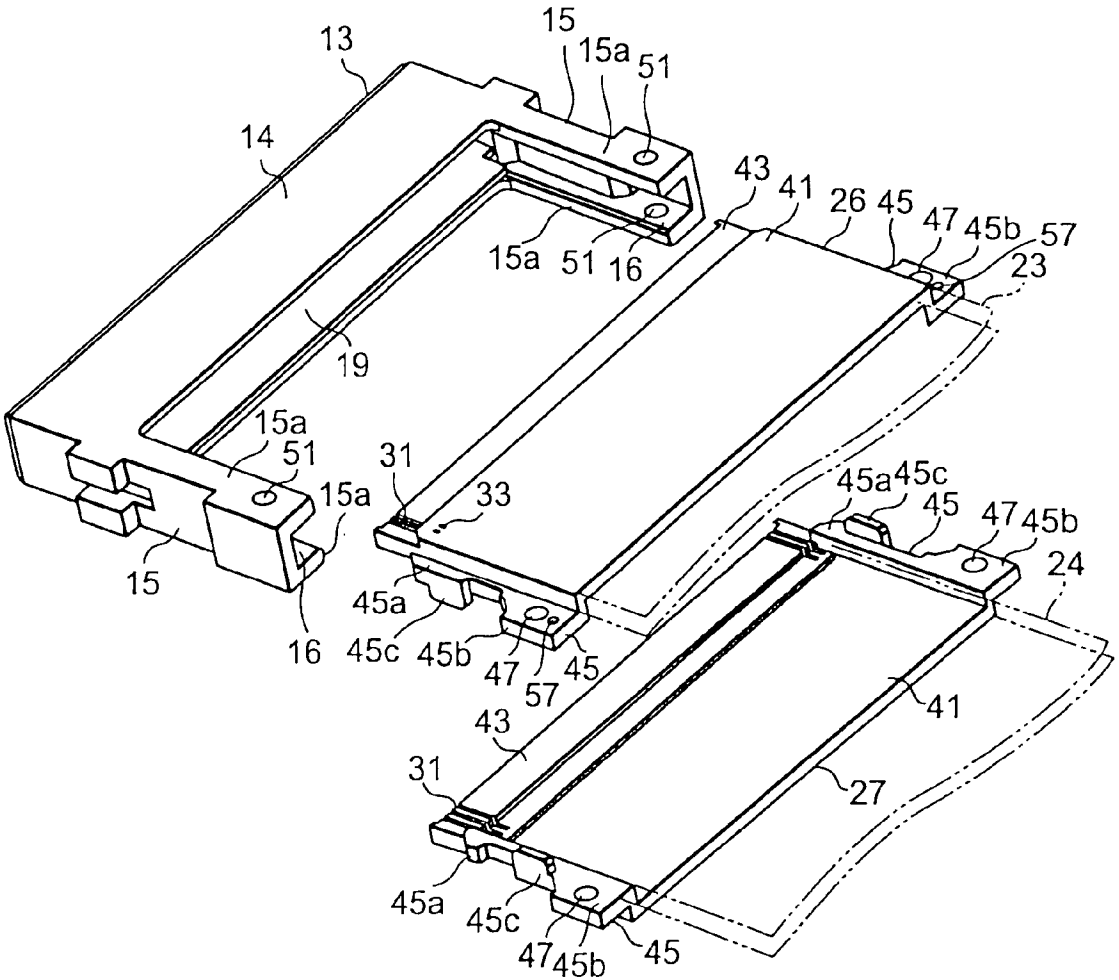
FIG. 6 is an exploded perspective view of the cable connector of FIG. 5.
Figure 7:
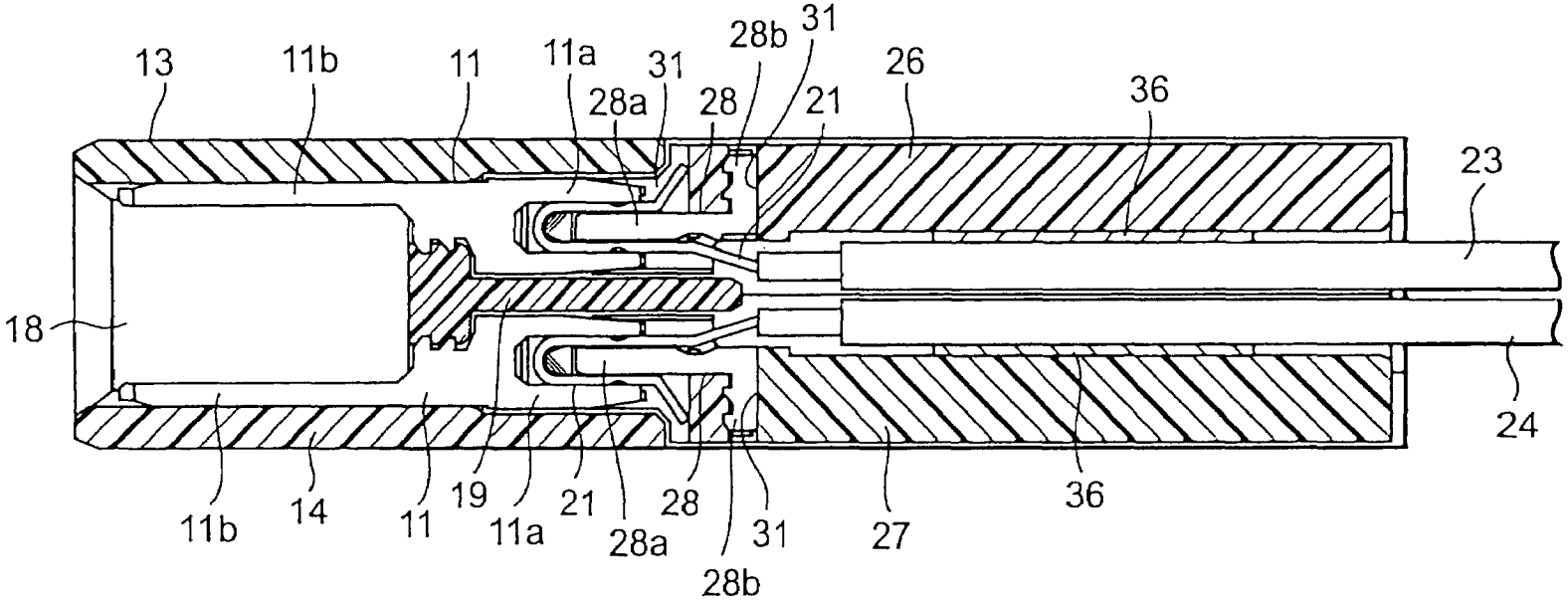
FIG. 7 is an enlarged sectional view taken along line VI—VI in FIG. 5, wherein cables are connected.
Figure 8:
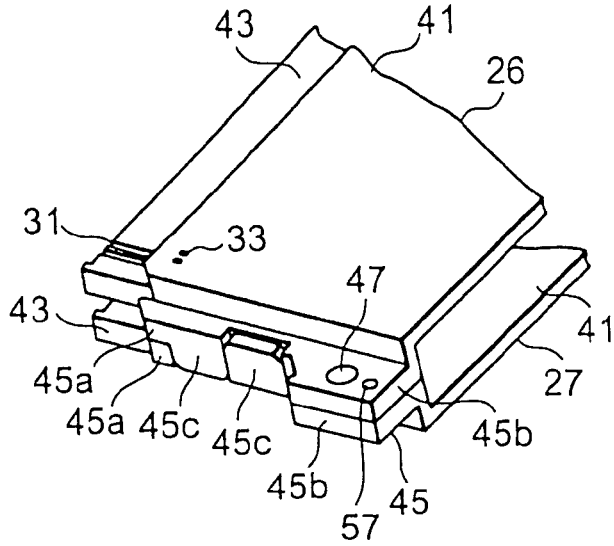
FIG. 8 is a perspective view of only a part in the state where two cover insulators included in the cable connector of FIG. 5 are mated to each other.
Figure 9:
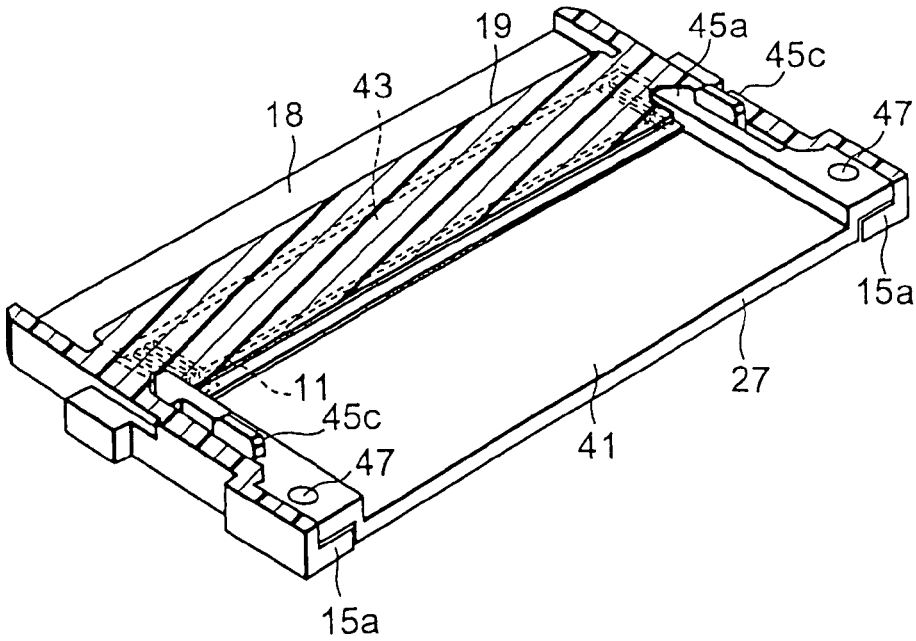
FIG. 9 is an enlarged sectional view of a base insulator included in the cable connector of FIG. 5, taken along line IX—IX in FIG. 5.

Referring to FIGS. 5 to 9, description will be made of a cable connector according to a first embodiment of the present invention.

The illustrated cable connector comprises a plurality of conductive contacts 11 (see FIG. 7), a base insulator 13 retaining these contacts 11 arrayed in two rows, two cover insulators 26, 27 sandwiching two cables 23, 24 each like a flat ribbon cable formed with a plurality of wires 21 in a flat manner at predetermined intervals to each other, to thereby retain them, and a plurality of conductive cable-connection contacts 28 retained by the cover insulators 26, 27, respectively. The contact 11 comprises a socket portion 11*a* adapted to contact with the cable-connection contact 28, and a pin-shaped contact portion 11*b* adapted to contact with a counterpart contact of a counterpart connector not illustrated.

Each of the cover insulators 26, 27 is formed with a plurality of connection grooves 31 at one edge portion thereof, and with a plurality of holes 33 near these connection grooves 31. The cable-connection contact 28 comprises a pin-shaped connection contact portion 28*a* disposed in the connection groove 31, and a connection retaining portion 28*b* press-fitted into the hole 33.

The connection contact portion 28*a* provided on the upper cover insulator 26 is connected with an end portion of the wire 21 of the cable 23 in the state where the end portion enters the connection groove 31 and is wound round therein. The connection contact portion 28*a* provided on the lower cover insulator 27 is connected with an end portion of the wire 21 of the cable 24 in the state where the end portion enters the connection groove 31 and is wound round therein. The cover insulators 26, 27 conjointly form a cable-side insulator.

The base insulator 13 comprises a base portion 14 extending in an array direction of the contacts 11, and a pair of base guide portions 15 extending in an insert/draw direction perpendicular to the array direction from both ends of the base portion 14 while confronting each other. That is, observing the base insulator 13 in a plan view, a generally ⊐-shape is exhibited by the base portion 14 and the pair of base guide portions 15. Mutually confronting surfaces of the base guide portions 15 are each formed with a long base guide groove 16 extending in the insert/draw direction. The base portion 13 is formed with a fitting portion 18 that is open for receiving the counterpart connector (not illustrated)

fitted thereinto. When the counterpart connector is fitted into the fitting portion 18, the counterpart contacts of the counterpart connector are brought into contact with the contacts 11. Incidentally, in the base guide portion 15, a groove width of the base guide groove 16 is formed widest near an entrance portion located apart from the base portion 14 while slightly narrower at a deep portion near the base portion 14. The groove width of the base guide groove 16 will be made clear with later description.

The fitting portion 18 is partitioned into an upper portion and a lower portion by a partition plate 19 integral with the base portion 14. The contact portions 11*b* of the plurality of contacts 11 are arranged in each of the upper portion and the lower portion of the fitting portion 18. On the side opposite to the fitting portion 18, the socket portions 11*a* of the contacts 11 are arranged. Specifically, the socket portions 11*a* are located in the base portion 14 at portions deeper than the pair of base guide portions 15. The contacts 11 in the upper portion and the lower portion are arranged in a symmetrical manner, seen from the partition plate 19.

Connecting portions of the wires 21 connected to the connection contact portions 28*a* of the cable-connection contacts 28 provided on the upper cover insulator 26 enter the socket portions 11*a* of the upper contacts 11 so as to contact therewith. Connecting portions of the wires 21 connected to the connection contact portions 28*a* of the cable-connection contacts 28 provided on the lower cover insulator 27 enter the socket portions 11*a* of the lower contacts 11 so as to contact therewith. In this manner, the cable-connection contacts 28 serve as support contacts for supporting the connection of the cables 23, 24.

The cables 23, 24 are fixed to the cover insulators 26, 27 using double-coated tapes 36 or adhesives, respectively, and confront each other when the cover insulators 26, 27 are mated with each other. The cover insulators 26, 27 are formed in the same shape and size with each other, and come into the state to sandwich the cables 23, 24 therebetween when they are united together with one of them postured to turn round by an angle of 180 degrees. Inasmuch as the cover insulators 26, 27 have the same shape and size with each other, description will be given about the one cover insulator 26, while description about the other cover insulator 27 will be omitted by assigning the same symbols to the respective portions.

The cover insulator 26 comprises a main plate portion 41 of a rectangular shape having a width dimension equal to or slightly smaller than a width dimension between the base guide portions 15, a connection plate portion 43 integrally connected so as to project in a manner slightly descending stepwise relative to the main plate portion 41 at one side perpendicular to the width direction of the main plate portion 41, and a pair of cover guide portions 45 integrally connected so as to project in a manner slightly descending stepwise at both sides in the width direction of the main plate portion 41. In order to receive an end portion of the flat-shaped cable 23, the main plate portion 41 has the width dimension substantially equal to a width dimension of the end portion of the cable 23. The connection plate portion 43 is formed with the connection grooves 31 where the end portions of the wires 21 of the cable 23 enter and are wound round as described before.

The cover guide portions 45 project from the both sides in the width direction of the main plate portion 41. Specifically, the cover guide portions 45 comprise a pair of cover projecting portions 45*a* projecting outward relative to the main plate portion 41 near the connection plate portion 43, a pair of fixing plate portions 45*b* projecting largely outward relative to the width dimension of the main plate portion 41 on the side opposite to the connection plate portion 43, and a pair of engaging portions 45*c* formed in the insert/draw direction between the cover projecting portions 45*a* and the fixing plate portions 45*b*.

The pair of engaging portions 45*c* project and extend in a direction perpendicular to a plate thickness direction of the main plate portion 41 and, given a central point of the plane of the main plate portion 41, they are formed on a diagonal crossing the central point on the plane. That is, when the two cover insulators 26, 27 are combined, the engaging portions 45*c* of the one cover insulator 26 and the engaging portions 45*c* of the other cover insulator 27 are engaged with each other in the insert/draw direction. In this event, the fixing plate portions 45*b* of the one cover insulator 26 and the fixing plate portions 45*b* of the other cover insulator 27 are mated to each other on the plane parallel to the plane of the main plate portion 41. Further, the connection plate portion 43 of the one cover insulator 26 and the connection plate portion 43 of the other cover insulator 27 confront each other on the planes parallel to the plane of the main plate portion 41 at a predetermined interval therebetween.

The fixing plate portions 45 are formed with two cover through holes 47. Mutually parallel base guide plate portions 15*a* defining the base guide groove 16 of the base guide portion 15 are formed with base through holes 51 at corresponding positions.

The cover insulators 26, 27 are inserted into the base guide grooves 16 with the connection plate portions 43 facing forward, thereby to be retained by the base insulator 13. In this state, the wires 21 are brought into contact with the contacts 11. In the connected state after having brought the wires 21 into contact with the contacts 11, the base through holes 51 and the cover through holes 47 are located with their axes in a shared state.

In the state where the cover insulators 26, 27 are retained by the base insulator 13, the cover projecting portions 45*a* enter deep portions of the base guide grooves 16. Further, the fixing plate portions 45*b* are fitted into the base guide grooves 16 near the entrance side to prevent the cover insulators 26, 27 from being further inserted relative to the base insulator 13.

Figure 10:
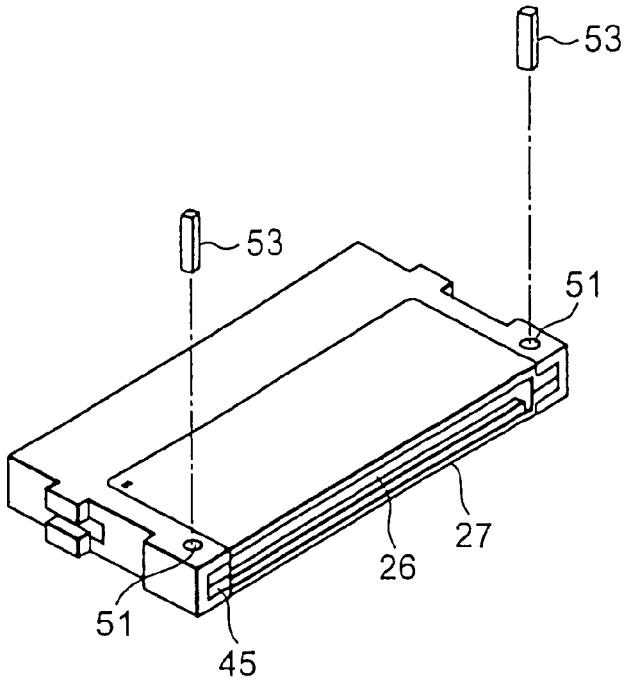
FIG. 10 is a perspective view for describing an operation after the cover insulators are fully inserted into the base insulator in the cable connector of FIG. 5.
Figure 11:
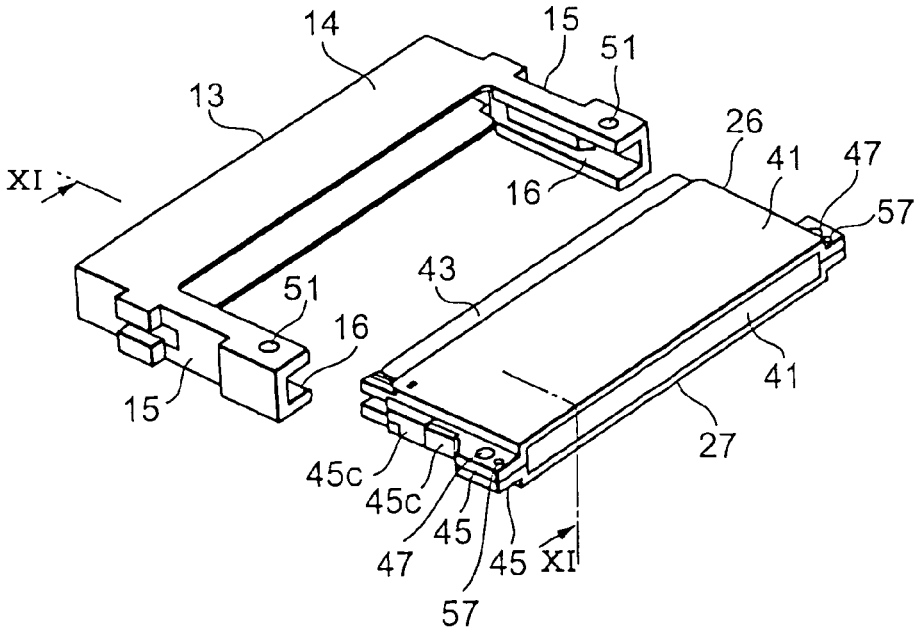
FIG. 11 is a perspective view showing the cable connector of FIG. 5 in the state before the cover insulators are inserted into the base insulator.
Figure 12:
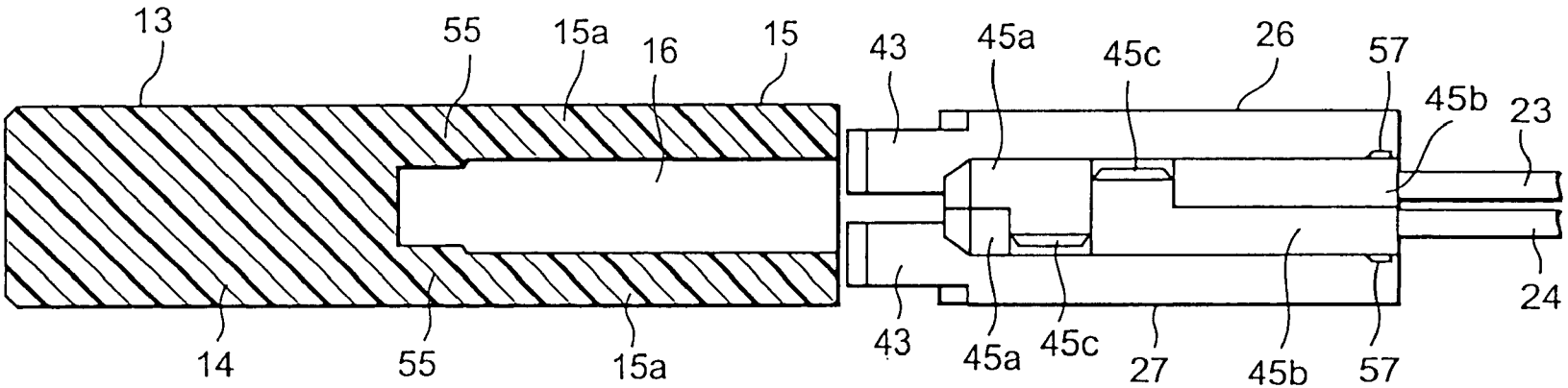
FIG. 12 is an enlarged sectional view taken along line XI—XI in FIG. 11.
Figure 13:
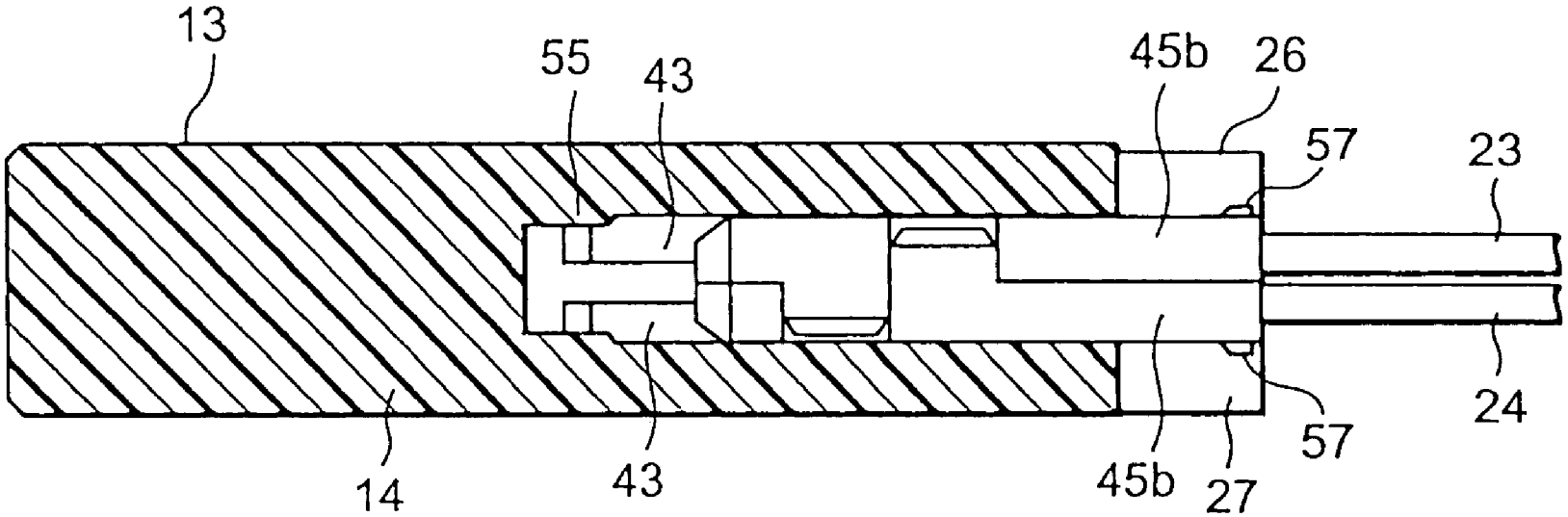
FIG. 13 is a sectional view, like FIG. 12, showing the cable connector of FIG. 5 in the state where the cover insulators are on the way to be inserted into the base insulator.
Figure 14:
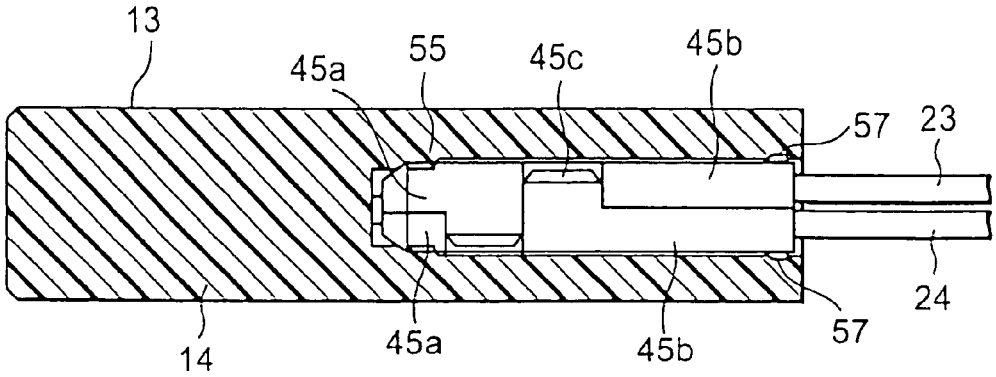
FIG. 14 is a sectional view, like FIG. 12, showing the cable connector of FIG. 5 in the state where the cover insulators are fully inserted into the base insulator.

Referring to FIG. 10, description will be made of an operation after the cover insulators 26, 27 are fully inserted into the base insulator 13.

When the cover insulators 26, 27 are fully inserted into the base insulator 13, the connected state is obtained as described above. Thereafter, pins 53 such as parallel pins or spring pins are driven to be inserted upright into the base through holes 51 and the cover through holes 47. The base insulator 13 is fixed to the cover insulators 26, 27 by the pins 53. In this manner, the cover insulators 26, 27 are prevented from coming off the base insulator 13. Therefore, even if the cables 23, 24 are pulled, the cover insulators 26, 27 do not come off the base insulator 13.

Further, at least either of the base guide portions 15 and the cover guide portions 45 are provided with press-fitted relation giving means for putting the base guide portions 15 and the cover guide portions 45 mutually into a press-fitted relation.

Referring to FIGS. 11 to 14, a specific example of the press-fitted relation giving means will be described.

The illustrated press-fitted relation giving means comprises base projection portions 55 formed on the base guide portion 15, and cover projection portions 57 formed on the cover guide portions 45. The base projection portions 55 are formed at deep portions near the base portion 14. The cover projection portions 57 are formed on outer surfaces of the fixing plate portions 45*b* at portions corresponding to the entrance portion apart from the base portion 14. Herein, a dimension between the base projection portions 55 is set smaller than the sum of thickness dimensions of the cover projecting portions 45*a* in the state where the cover insulators 26, 27 are mated. A dimension between tips of the cover projection portions 57 is set larger than a dimension between the base plate portions 15*a* (i.e. the groove width dimension of the base guide groove 16) at the entrance portion of the base guide portion 15.

Now, the cover guide portions 45 of the cover insulators 26, 27 are inserted into the base guide grooves 16 of the base insulator 13. On the way of insertion, tapered tip portions of the cover projecting portions 45*a* abut against the base projection portions 55. When the insertion is further continued, the cover projecting portions 45*a* are press-fitted into between the base projection portions 55. Thereafter, when the fixing plate portions 45*b* are fully inserted into the base guide grooves 16, the press-fitting of the cover projecting portions 45*a* into between the base projection portions 55 is completed.

In this event, the wires 21 contact with the socket portions 11*a* of the contacts 11 so that the connected state is obtained. Since the cover projecting portions 45*a* are firmly press-fitted to the base projection portions 55 to be retained thereby, even if the cables 23, 24 are rocked upward, downward, leftward, or rightward by an external force, possibility is small that the connected state is loosened. Particularly, inasmuch as it is configured that the press-fitted relation is achieved immediately before the connected state is obtained, the insertion of the cover insulators 26, 27 relative to the base insulator 13 can be smoothly carried out with a small force.

Figure 15:
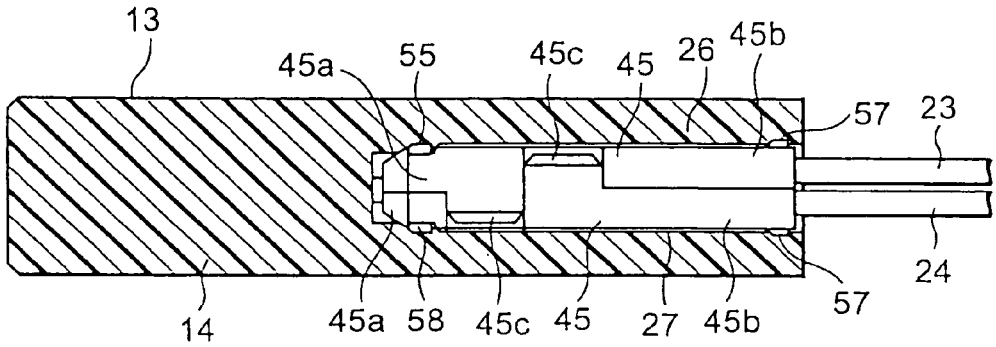
FIG. 15 is a sectional view, like FIG. 13, showing a modification of the cable connector of FIG. 5.

Referring to FIG. 15, another specific example of the press-fitted relation giving means will be described.

In the illustrated press-fitted relation giving means, the cover guide portion 45 further comprises a cover projection portion 58. The one cover projection portion 57 is formed at a position of the base guide portion 45 corresponding to the entrance portion, while the other cover projection portion 58 is formed at a position of the cover guide portion 45 corresponding to the deep portion. That is, the one cover projection portion 57 is formed on the outer surface of the cover projecting portion 45*b*, while the other cover projection portion 57 is formed on the outer surface of the fixing plate portion 45*a*. Incidentally, the groove width dimension of the base guide groove 16 is constant.

Even with such cover projection portions 57, 58, the cover guide portions 45 are press-fitted into the base guide grooves 16 to be retained thereby. Therefore, even if the cables 23, 24 are rocked upward, downward, leftward, or rightward by an external force, possibility is small that the connected state is loosened.

Figure 16:
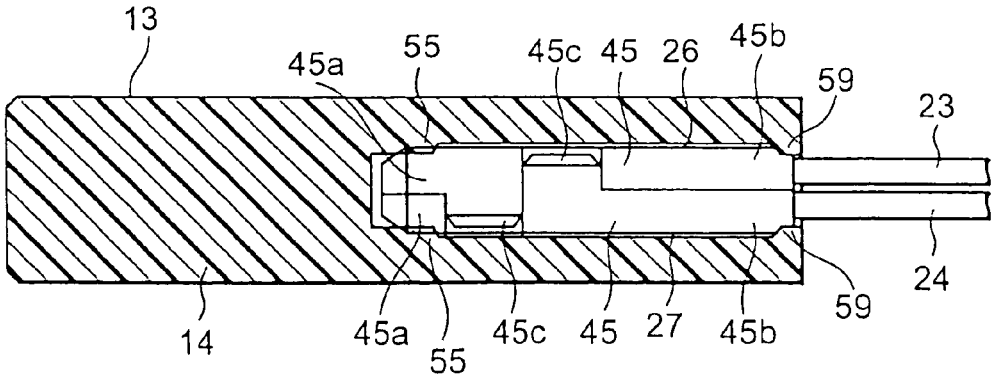
FIG. 16 is a sectional view, like FIG. 13, showing another modification of the cable connector of FIG. 5.

Referring to FIG. 16, another specific example of the press-fitted relation giving means will be described.

The illustrated press-fitted relation giving means comprises base projection portions 55 formed at a deep portion of the base guide groove 16 so as to narrow the groove width thereof, and base projection portions 59 formed at an entrance portion of the base guide groove 16 so as to narrow the groove width thereof.

Even with such base projection portions 55, 59, the cover guide portions 45 are press-fitted into the base guide grooves 16. Therefore, even if the cables 23, 24 are rocked upward, downward, leftward, or rightward by an external force, possibility is small that the connected state is loosened.

Figure 17:
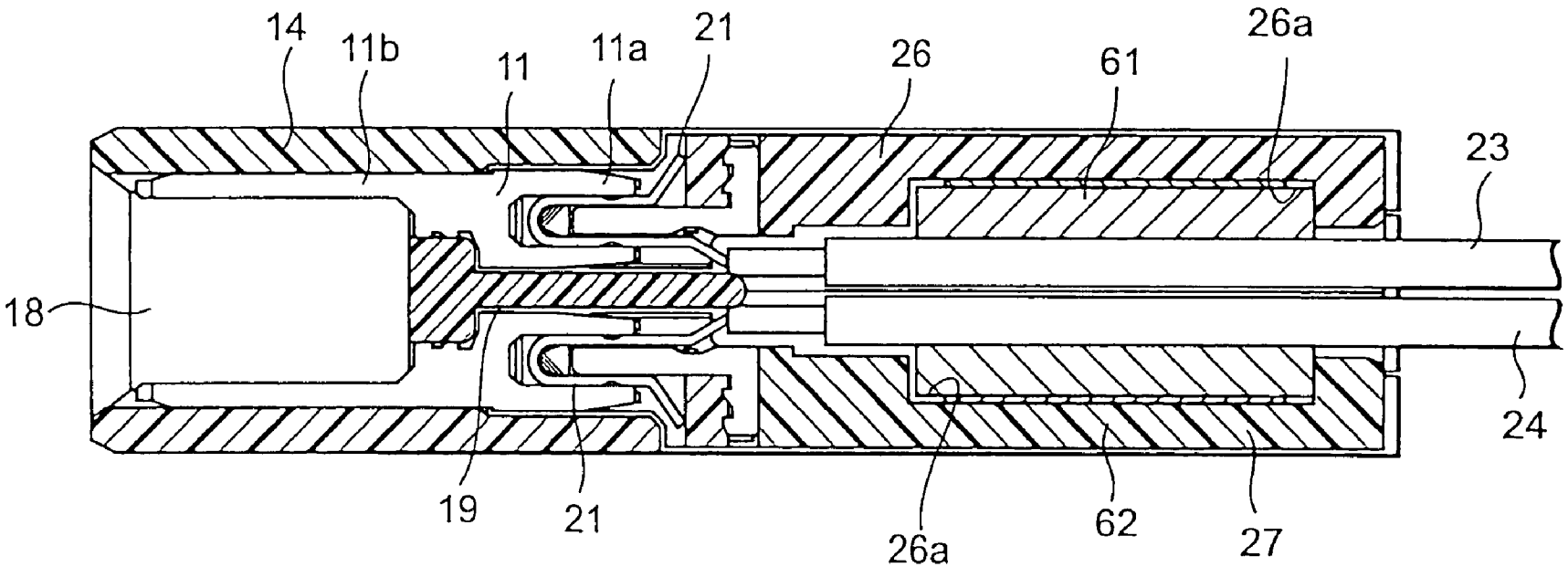
FIG. 17 is a sectional view showing a cable connector according to a second embodiment of the present invention in a connected state.
Figure 18:
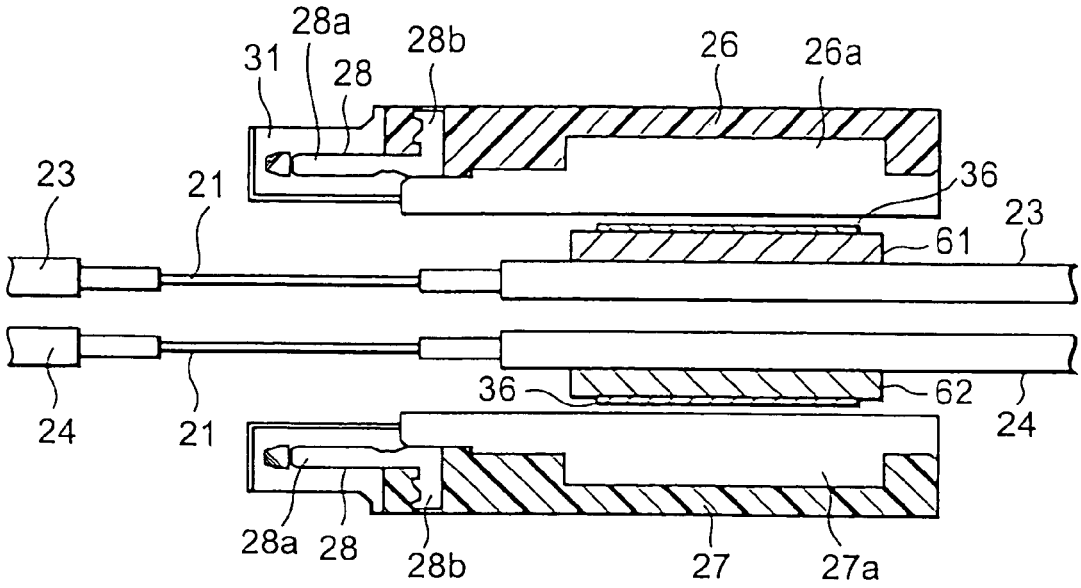
FIG. 18 is an exploded sectional view showing part of the cable connector of FIG. 17.

Referring to FIGS. 17 and 18, description will be made of a cable connector according to a second embodiment of the present invention. Like portions are assigned the same symbols to thereby omit description thereof.

The illustrated cable connector comprises two plates 61, 62 received between cover insulators 26, 27 and fixed with end portions of cables 23, 24 on outer sides thereof. The cover insulators 26, 27 have mutually confronting surfaces on which concave portions 26*a* are formed for retaining the plates 61, 62, respectively. The plates 61, 62 are fixed to both surfaces of the cables 23, 24, respectively. The cables 23, 24 are sandwiched between the cover insulators 26, 27 so as to be retained.

Figure 19:
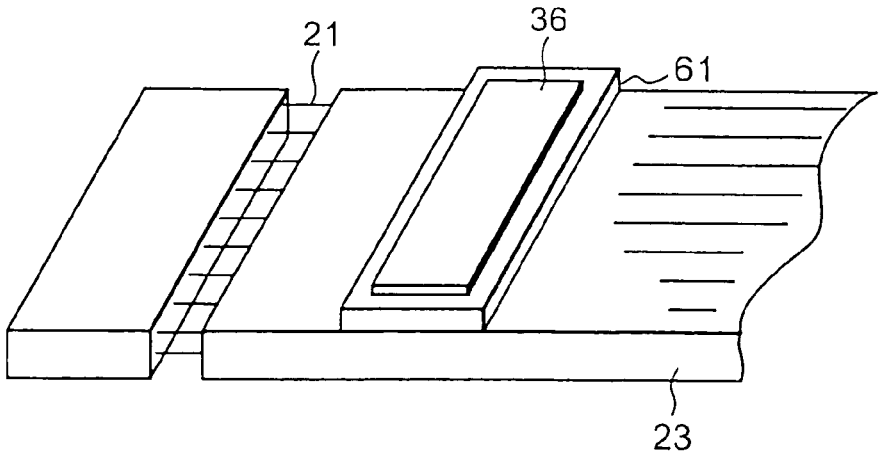
FIG. 19 is a perspective view showing part of a cable connectable by the cable connector of FIG. 18.

Referring also to FIG. 19, an assembly process of this cable connector will be described.

At the outset, the plates 61, 62 are fixed to the cables 23, 24. Using this as a reference, coatings of the cables 23, 24 are partly stripped by the use of a stripping machine to expose wires 21. Then, the cables 23, 24 are fixedly fitted to the concave portions 26*a* of the cover insulators 26, 27 shown in FIG. 14, using double-coated tapes 36 or adhesives. Further, after winding the wires 21 around connection contact portions 28*a* of cable-connection contacts 28, the wires 21 are cut into a fixed length dimension at winding ends, so that the wires 21 are set in connection grooves 31.

In the connected state, since the plates 61, 62 are received in the concave portions 26*a* of the cover insulators 26, 27, a retaining force for the cables 23, 24 can be set sufficiently large.

Figure 20:
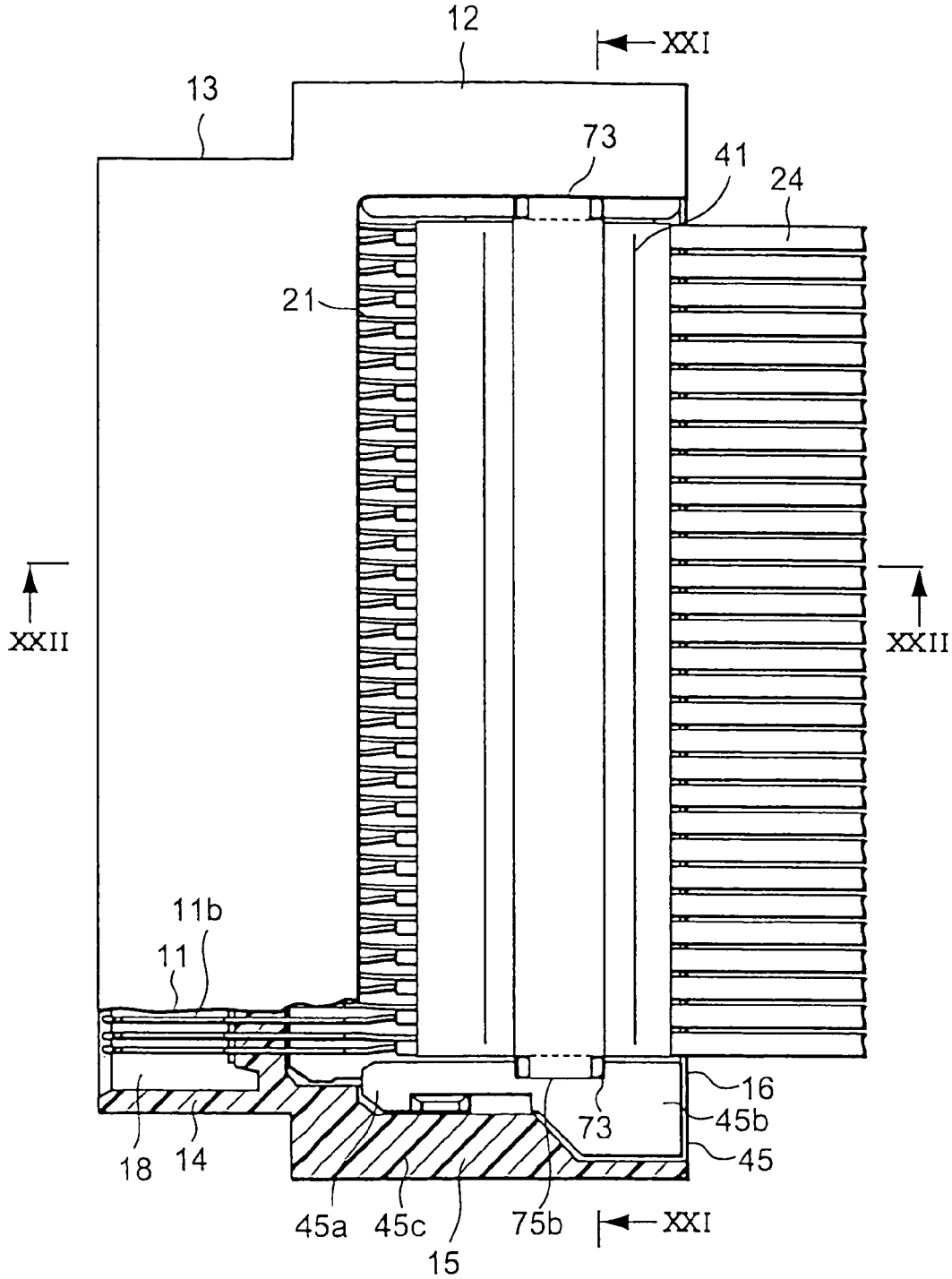
FIG. 20 is a plan view showing, partly in section, a cable connector according to a third embodiment of the present invention.
Figure 21:
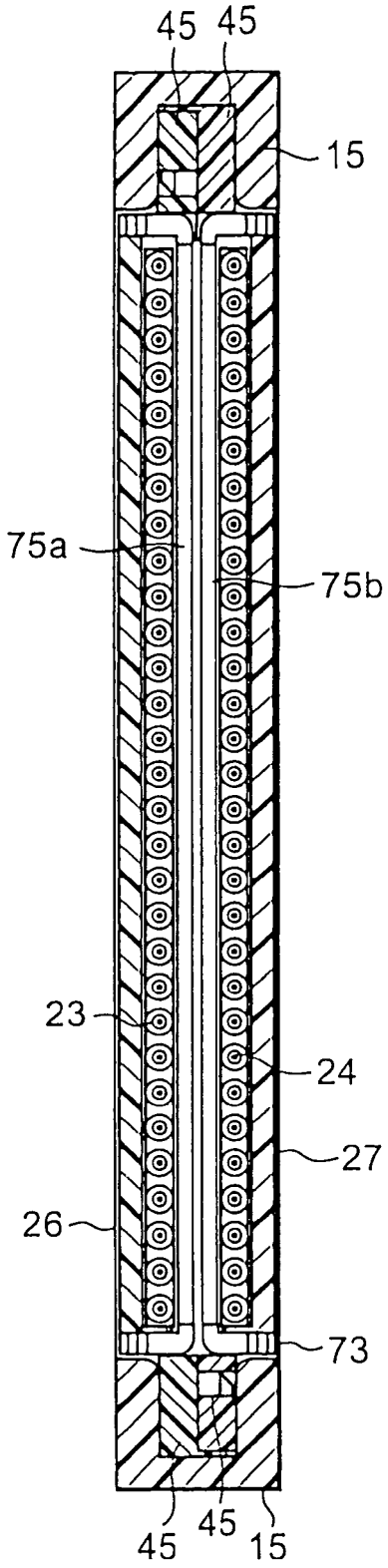
FIG. 21 is a sectional view taken along line XXI—XXI in FIG. 20.
Figure 22:
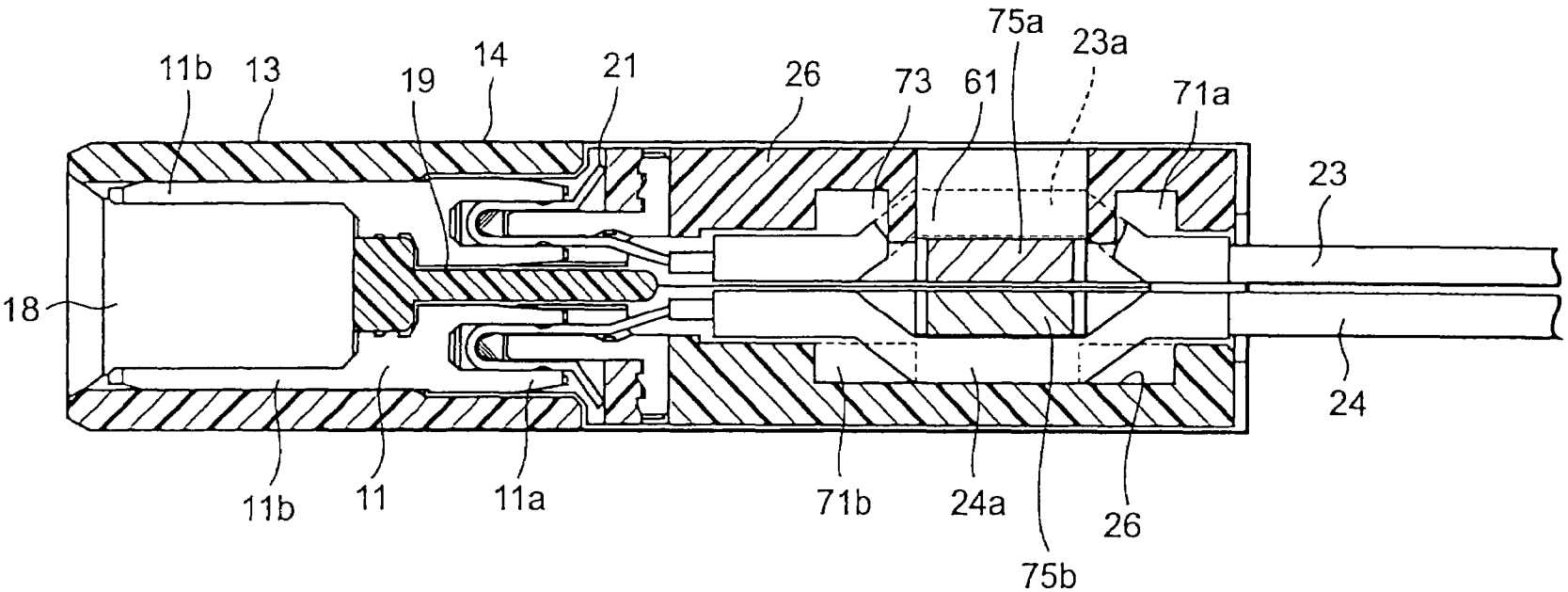
FIG. 22 is a sectional view taken along line XXII—XXII in FIG. 20.

Referring to FIGS. 20 to 22, description will be made of a cable connector according to a third embodiment of the present invention. Like portions are assigned the same symbols to thereby omit description thereof.

In the illustrated cable connector, cables 23, 24 have crank portions 23*a*, 24*a* each formed into a crank shape. Cover insulators 26, 27 have clamp grooves 71*a*, 71*b* for receiving the crank portions 23*a*, 24*a* inserted therein, and locking holes 73.

Further, the cable connector comprises locking members (cable clamp members) 75*a*, 75*b* for retaining/fixing the cables 23, 24 to the cover insulators 26, 27.

The locking members 75*a*, 75*b* are each formed into a generally ⊐-shape in section by pressing a metal plate to bend both end portions thereof in a longitudinal direction at a substantially right angle in the same direction. During the assembly operation for fixing the cables 23, 24 to the cover insulators 26, 27, in the state where the cables 23, 24 are processed into the crank shape and stripped portions of the cables 23, 24 are arrayed on the cover insulators 26, 27, the locking members 75*a*, 75*b* are driven into the locking holes 73 of the cover insulators 26, 27 to be press-fitted/fixed thereto in such a manner as to cover the crank portions 23*a*, 24*a*. In this state, the cables 23, 24 are fixed to the cover insulators 26, 27. By driving a base insulator 13 having contacts 11 provided in a base portion 14 in the state where the two sets of them are united together face to face, the connection is completed.

Figure 23:
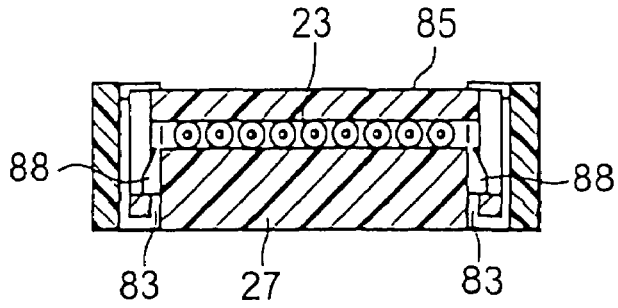
FIG. 23 is a sectional view of a cable connector according to a fourth embodiment of the present invention.
Figure 24:
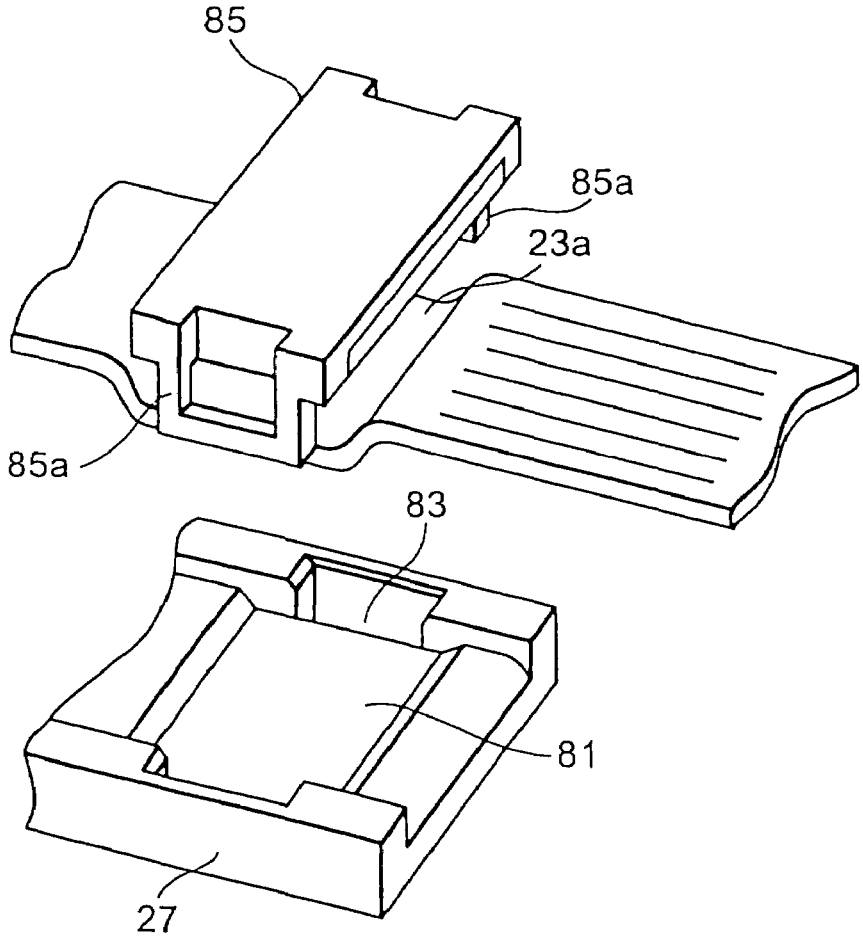
FIG. 24 is an exploded perspective view showing the main part of the cable connector of FIG. 23.

Referring to FIGS. 23 and 24, description will be made of a cable connector according to a fourth embodiment of the present invention. Like portions are assigned the same symbols to thereby omit description thereof.

In the illustrated cable connector, a cable 23 has a crank portion 23*a* formed into a crank shape. A cover insulator 27 has a clamp groove 81 for receiving the crank portion 23*a* inserted therein, and locking holes 83.

Further, the cable connector comprises a locking member (cable clamp member) 85 for retaining/fixing the cable 23 to the cover insulator 27.

The locking member 85 has both sides in a longitudinal direction formed with a pair of locking portions 85*a* extending at a right angle in the same direction. The pair of locking portions 85*a* enter the locking holes 83 to be engaged with locking projections 88 formed in the locking holes 83.

When outer coating of one cable 23 is thin and weak, damage can be reduced by employing such a locking member 85. An assembly operation of this cable connector is carried out like the case of the cable connector as described with reference to FIGS. 20 to 22.

The foregoing description has been given about the example wherein the two cables are sandwiched between the two cover insulators and, by uniting the two insulators together, the two cables are retained/fixed, and the example wherein the one cable is sandwiched using the one cover insulator. However, it is needless to say that it is possible to configure such that three or more cables are retained/fixed by three or more cover insulators, or retained/fixed by three or more plates.

INDUSTRIAL APPLICABILITY

The cable connector of the present invention is suitable as a connection device for connecting a cable used in a computer, a portable telephone, or the like.

The invention claimed is:

1. A cable connector used for connecting a cable having a plurality of wires, said cable connector comprising:

a plurality of conductive contacts;

a base insulator retaining said contacts; and a cable-side insulator attachable/detachable relative to said base insulator, arraying and retaining said wires in one plane, and connecting said wires to said contacts when attached to said base insulator, wherein said base insulator has a base portion arraying said contacts at predetermined intervals to each other, and a pair of base guide portions extending from both ends of said base portion while confronting each other, said cable-side insulator has a pair of cover guide portions of which movement is guided by said base guide portions, each of said base guide portions having a base projection portion formed in said base guide groove, each of said cover guide portion having a cover projection portion press-fitted into the base projection portion in a cable connected state where said wires are connected to said contacts, said cable-side insulator being held by said base insulator by a press-fit relationship between said base projection portion and said cover projection portion and a locking member confronting said cable-side insulator via said cable, wherein said cable has a crank portion formed into a crank shape and confronting said locking member, and said cable-side insulator has a clamp groove for receiving said crank portion inserted therein.

2. A cable connector according to claim 1, wherein each of said base guide portions has a deep portion near said base portion and an entrance portion apart from said base portion, said base projection portion being formed at the deep portion, said cover projection portion being located at a position corresponding to the deep portion.

3. A cable connector according to claim 1, wherein each of said base guide portions has a deep portion near said base portion and an entrance portion apart from said base portion, said base projection portion being formed at the entrance portion, the cover projection portion being located at a position corresponding to the entrance portion.

4. A cable connector according to claim 1, wherein each of said base guide portions has a deep portion near said base portion and an entrance portion apart from said base portion, said base projection portions being formed at the deep portion and the entrance portion, said cover projection portions being located at positions corresponding to the deep portion and the entrance portion.

5. A cable connector according to claim 1, further comprising through holes penetrating said base guide portions and said cover guide portions in said cable connected state, and pins inserted into said through holes to engage said base insulator and said cable-side insulator with each other.

6. A cable connector according to claim 1, wherein said cable-side insulator comprises a pair of cover insulators sandwiching and retaining said cable.

7. A cable connector according to claim 1, further comprising a plate fixed to said cable, wherein said cable-side insulator has a concave portion for retaining said plate.

8. A cable connector according to claim 7, wherein said cable-side insulator comprises a pair of cover insulators sandwiching and retaining said cable via said plate.

9. A cable connector according to claim 1, wherein said locking member is formed into a generally U-shape in section by pressing a metal plate.

10. A cable connector according to claim 9, wherein said locking member is made of resin.

* * * * *

UNITED STATES PATENT AND TRADEMARK OFFICE

CERTIFICATE OF CORRECTION

PATENT NO. : 7,070,444 B2
APPLICATION NO. : 10/490668
DATED : July 4, 2006
INVENTOR(S) : Sato et al.

It is certified that error appears in the above-identified patent and that said Letters Patent is hereby corrected as shown below:

In particular, on the cover page, column 1, item [73], please include the name of the second assignee to correctly read: --NEC Corporation Tokyo, Japan--.

Signed and Sealed this

Twelfth Day of June, 2007

JON W. DUDAS
*Director of the United States Patent and Trademark Office*